US006739466B1

(12) United States Patent
Culley

(10) Patent No.: US 6,739,466 B1
(45) Date of Patent: May 25, 2004

(54) FOLDING FINGER TAMPER-INDICATING BAND ARRESTER

(75) Inventor: Brian K. Culley, Mount Vernon, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 10/263,978

(22) Filed: Oct. 3, 2002

(51) Int. Cl.[7] ..... B65D 41/34

(52) U.S. Cl. ..... 215/252; 215/258; 215/216; 215/901

(58) Field of Search ..... 215/216, 252, 215/258, 901

(56) References Cited

U.S. PATENT DOCUMENTS

| | | | | |
|---|---|---|---|---|
| 4,485,934 A | | 12/1984 | Maguire | |
| 4,509,654 A | | 4/1985 | Maguire | |
| 4,669,623 A | | 6/1987 | Csaszar | |
| 4,801,030 A | * | 1/1989 | Barriac | 215/252 |
| 4,907,708 A | | 3/1990 | Csaszar | |
| 4,938,370 A | | 7/1990 | McBride | |
| 4,978,017 A | | 12/1990 | McBride | |
| 5,007,545 A | | 4/1991 | Imbery, Jr. | |
| 5,097,974 A | | 3/1992 | Rozenberg | |
| 5,423,441 A | | 6/1995 | Conti | |
| 5,450,973 A | * | 9/1995 | Ellis et al. | 215/252 |
| 5,667,087 A | * | 9/1997 | Delatour et al. | 215/252 |
| 5,740,933 A | | 4/1998 | Conti et al. | |
| 6,126,025 A | * | 10/2000 | Recendez M. | 215/252 |
| 2001/0002661 A1 | | 6/2001 | Reidenbach | |

* cited by examiner

*Primary Examiner*—Lee Young
*Assistant Examiner*—James Smalley
(74) *Attorney, Agent, or Firm*—John F. Salazar; James E. Cole; Middleton Reutlinger

(57) ABSTRACT

A tamper-indicating band arrester including a closure having a tamper-indicating band depending therefrom. The tamper-indicating band has a plurality of folding fingers of alternating first and second lengths extending inwardly. The fingers of a longer length have an offset surface disposed at a distal end, which engage a container neck finish bead preventing tiring of the tamper-indicating band.

11 Claims, 3 Drawing Sheets

FOLDING FINGER TAMPER-INDICATING BAND ARRESTER

BACKGROUND OF THE INVENTION

1. Technical Field of the Invention

The present invention generally relates to a tamper-indicating band. More particularly the design relates to a tamper-indicating band promoting full fracture of the frangible webs of the tamper-indicating band and inhibiting only partial rupture and "tiring" of the tamper-indicating band over a container finish bead.

2. Description of the Related Art

Tamper-indicating bands are known in the art as having frangible webs or bridges. The tamper-indicating bands are typically formed in a releasably depending manner from a lower edge of a closure such that threaded removal of the closure from a container neck results in a discernable alteration of the closure and tamper indicating band. In other words, the frangible webs of the tamper-indicating band break such that the tamper-indicating band remains on the container neck and a consumer knows the container has been previously opened. Ideally, when initially unscrewed, all of the frangible bridges or webs should break resulting in detachment of the tamper-indicating band from the closure. However, in many cases the tamper-indicating band does not completely break from the closure resulting in a detached portion and an attached portion of the tamper-indicating band.

When incomplete separation of the tamper-indicating band occurs, the detached portion of the tamper-indicating band typically falls below a finish bead located along the container neck and shifts inwardly toward the container neck as the closure is unscrewed. The attached portion of the tamper-indicating band therefore necessarily moves outward away from the tamper-indicating or finish bead of the container neck finish. As the closure is unscrewed, the attached portion tires over the finish bead followed by the detached portion tiring over the finish bead. As a result, the tamper-indicating band may be removed from the neck finish which is undesirable, particularly when it is desired to leave the fractured tamper-indicating band on the neck finish as tactile evidence of prior opening.

In view of the deficiencies in known tamper-indicating bands, it is preferable to have a tamper-indicating band which inhibits the "tiring" of the tamper-indicating band over the finish bead as a closure is initially removed from the container. It is also desirable that the design promote more efficient breaking of the frangible webs.

SUMMARY OF THE INVENTION

It is object of the present invention to Provide a tamper-indicting band frangibly attached to a closure.

It is an additional object of the present invention to provide a design promoting full fracture of a plurality of frangible webs releasably connecting the closure and tamper-indicating band.

It is a further object of the present invention to inhibit "tiring" of a tamper-indicating band over a container neck or finish bead.

It is even further object of the present invention to provide a tamper-indicating band with a plurality of inwardly projecting fingers.

It is still an even further object of the present invention to provide a tamper-indicating band having folding fingers of alternating first and second lengths.

It is yet a further object of the present invention to provide a protrusion on the fingers of the second length inhibiting downward axial movement of the tamper-indicating band.

In accordance with the present invention, a tamper-indicating band arrester formed of, for instance, polypropylene or polyethylene by, for example, injection molding or compression molding techniques is provided for a closure having a top wall and an annular skirt depending from a peripheral edge of the top wall such that the closure is generally cup-shaped. The skirt has a thread helically extending along an inner surface thereof and a tamper-indicating band releasably or frangibly connected to the skirt proximal a lower edge of the skirt, which defines an opening in the closure. Extending inwardly from an inner surface of the tamper-indicating band are a plurality of folding-fingers having alternating first and second lengths. The folding fingers of the first length may be shorter than the folding fingers of the second length however, in the alternative the folding fingers of the second length may be shorter than the folding fingers of the first length if the first length folding fingers extend above the neck bead.

The closure may be threadably disposed on a container neck finish having at least one thread helically extending thereabout. The neck finish may also include a finish or neck bead extending about the circumference of the neck beneath the at least one external thread. When the closure is disposed in a fully closed position, a distance "W" is defined between an outer surface of the finish bead and an inner surface of the closure skirt or tamper-indicating band. The alternating folding fingers of longer length extend above the finish bead such that a protrusion, extending from for example a distal end of the longer length fingers, is positioned above the finish bead. The protrusion preferably has a radial dimension that is sized greater than the distance "W". Additionally, the radially innermost surface of the protrusions define a diameter which is smaller than the outer diameter of the neck finish bead. Thus, the size of the protrusion prevents it from falling beneath the neck finish bead since the protrusion is in interference engagement with the neck finish bead. With the protrusion inhibited from falling beneath the neck bead on one side of the finish bead, the tamper-indicating band cannot "tire" over the neck finish bead as in the prior art.

In use the closure with tamper-indicating band may be molded having folding fingers extending downwardly therefrom. The closure is applied to a neck finish of a container which is filled with product. As the closure is applied the folding fingers of alternating first and second lengths are directed upwardly and inwardly until the closure is fully seated on the container neck, preferably sealingly engaging the container neck. The first fingers of a shorter length are directed upwardly toward a lower surface of the finish bead. The second fingers of longer length are directed upwardly above the finish bead so that the protrusion is positioned above and engaging an upper surface of the finish bead.

As the closure is initially removed, the shorter length fingers engage the lower surface of finish bead and inhibit vertical movement of the tamper-indicating band relative to the closure and neck finish. Since the closure continues upward axial movement, the frangible webs begin rupturing. As the frangible webs rupture, the protrusions inhibit downward movement of the detached portion of the tamper-indicating band which typically leads to "tiring" and incomplete detachment of the tamper-indicating band from the closure. Thus, the frangible webs and tamper-indicating band completely break free of the closure so that the tamper-indicating band remains on the container neck visually signaling that the container has been initially opened.

All of the above outlined objectives are to be understood as exemplary only and many more objectives of the invention may be understood from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
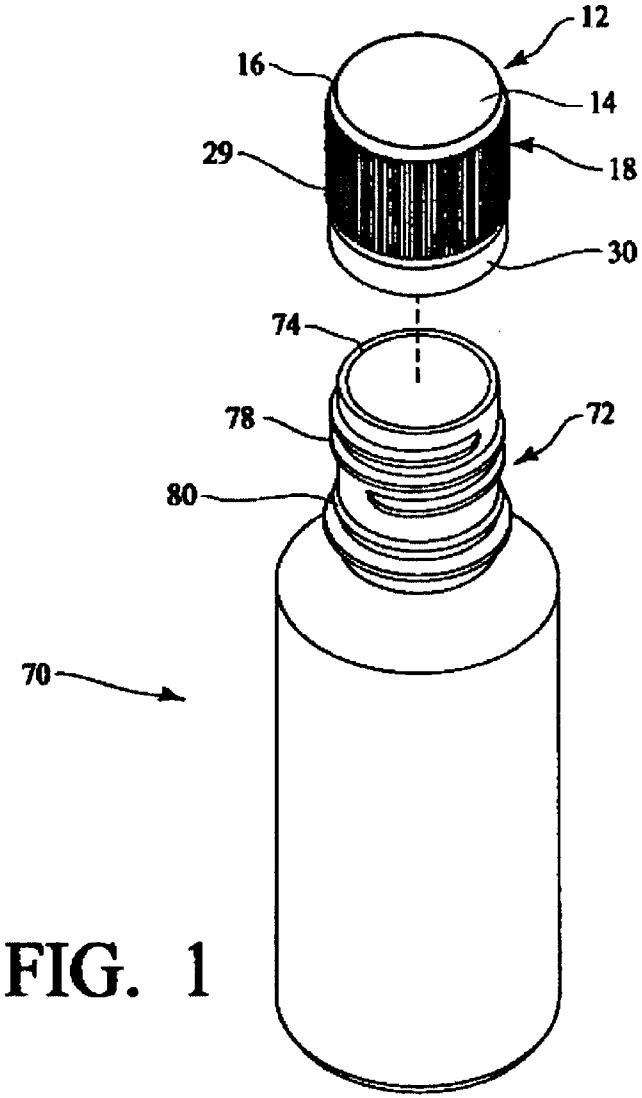
FIG. 1 shows an exploded view of a typical closure of the present invention and a container for use therewith.

The present invention will now be described in conjunction with the drawings, referring initially to FIGS. 1,3, and 4, a tamper-indicating band arrester 10 of the present invention is shown. The tamper-indicating band arrester 10 may be used with a plurality of devices necessitating tamper indication including standard closures, push-pull type threadably engaged closures, flip-top closures or the like. The exemplary closure 12 of the present embodiment may be threadably connected to a container 70. FIGS. 1 and 4 depict the container 70 having a neck finish 72 and an upper edge 74 of the neck finish 72 defining a mouth or flow communication path 76. The neck finish 72 further comprises at least one external thread 78 extending helically about the outer surface thereof and a neck finish bead 80.

An exemplary closure 12 is depicted in FIGS. 1,3,4, and 5 having a circular top wall 14 and a peripheral edge 16. Depending from the peripheral edge 16 is an annular skirt 18 defining a cavity for receiving a container neck finish 72. A lower edge portion of the skirt 18 defines an opening of the cavity wherein a container neck finish 72 may be threadably disposed. The annular skirt 18 has an outer surface 24 and an inner surface 26, the inner surface 26 having at least one internal thread 28 helically extending there about, as seen in FIG. 4. Extending vertically along an outer surface of the closure 12 may be a plurality of knurlings or axial ribs 29, or other similar texturing to enhance gripping and torque for application and removal of the closure 12 from a container 70. Depending from an inner surface of the top wall 14 may be a seal. Various types of seals may be implemented including a plug seal, a reverse taper plug seal, an e-seal, a re-seal liner, a malleable seal material positioned along the inner surface of the top wall, or other seals known by one of ordinary skill in the art. However, a seal is not essential to practice this invention and therefore should not be considered limitative.

The closure 12 having the above described embodiments may be formed of a rigid or semi-rigid polymeric material such as polyethylene, polypropylene, or some other material commonly known to one of ordinary skill in the art for use in compression or injection molding. Moreover, the closure 12 may be formed having a plurality of dimensions depending on the desired use of the closure and container associated therewith.

Figure 3:
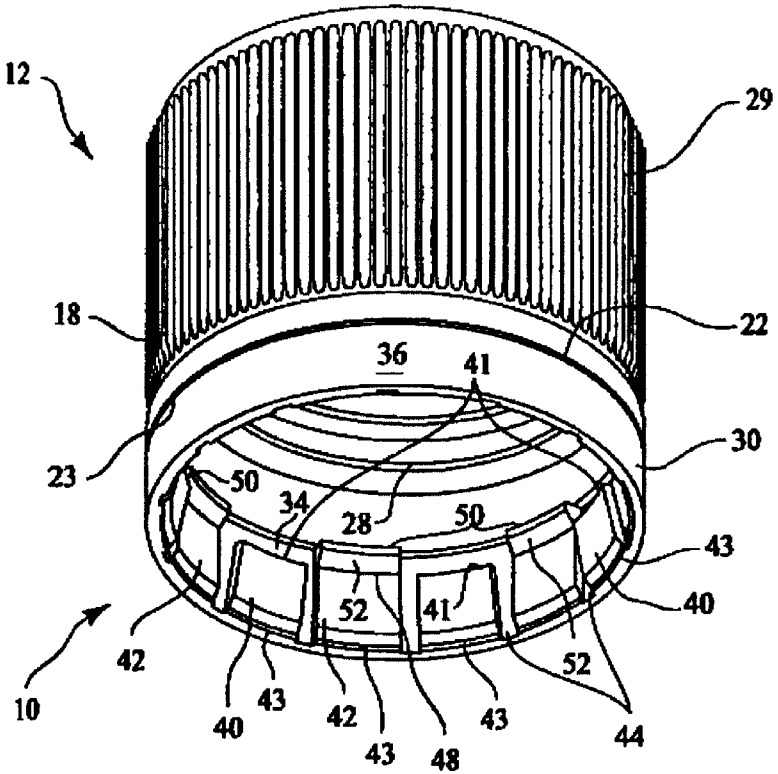
FIG. 3 shows a bottom perspective view of the closure of FIG. 1 having a tamper-indicating band arrester of the present invention.
Figure 4:
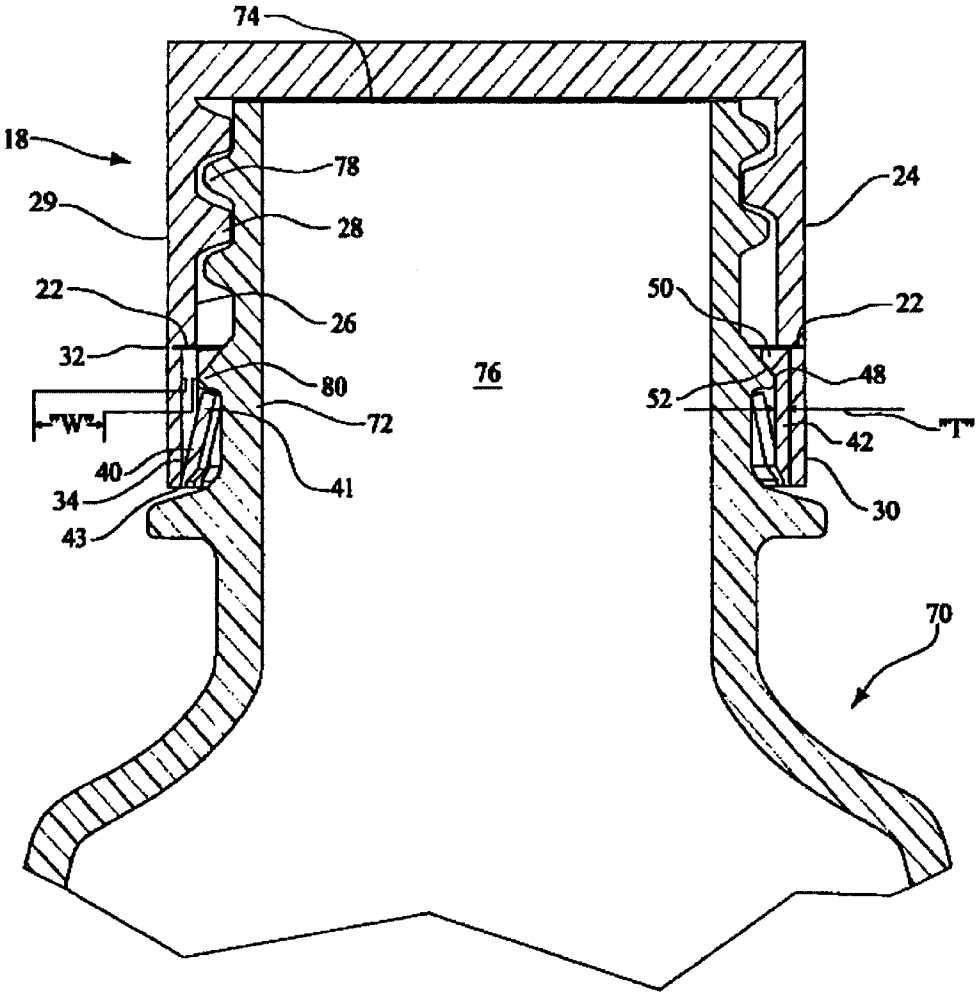
FIG. 4 shows sectional view of the tamper-indicating band arrester of FIG. 3 engaging a container neck finish; and, FIG. 5 shows a side view of a closure having a tamper-indicating band positioned at an angle from the vertical and having the tamper-indicating band arrester of the present invention.

Referring now to FIGS. 3 and 4, depending from the lower edge 22 of the skirt is a tamper-indicating or pilfer band 30 which may be frangibly or releasably connected to the closure 12 by at least one frangible web 32. The at least one frangible web 32 may be formed by molding the webs 32 during formation of the closure 12 or cutting a score line 23 in the tamper-indicating band 30 after the closure 12 has been formed such as, for example, with a rotary cutter, a laser cutter, a high pressure water jet, an interrupted knife, or the like. The webs 32 may be disposed about a circumference defined by the lower edge 22 of skirt 18. Alternatively, the webs 32 may extend from the inner or outer surface of the annular closure skirt 18. The webs 32 may extend vertically downward or may be diagonally positioned to inhibit breakage during application of the closure 12 and to promote breakage during removal from the container neck finish 72.

Figure 5:
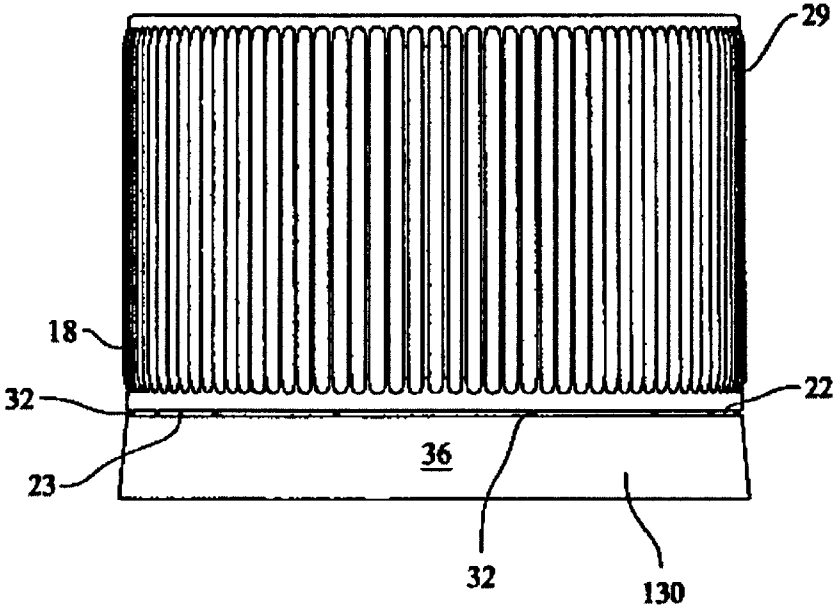

The tamper-indicating band 30 is substantially circular in shape having an inner and an outer band surface 34,36. The outer surface of the tamper-indicating band 30 may be vertically aligned with the outer surface of the skirt 24 as shown in FIGS. 1,3,4 or offset either inwardly or outwardly therefrom. FIG. 5 shows a third alternative wherein the tamper-indicating band 130 may be positioned at an angle to the longitudinal axis of the closure 12 such that a lower edge portion of the band 130 has a greater diameter than an upper edge portion. This angle design promotes removal of the closure from the mold, provides additional clearance for positioning a neck or neck finish 72 therein during manufacturing while also providing additional clearance for folding fingers 40,42

Extending from near a lower edge portion of the tamper-indicating band 30,130 are a plurality of folding fingers 40,42 of first and second lengths, respectively. For example, the folding fingers 40,42 may be extending from near a lower edge portion of the band 30,130 including a lower inner surface of the tamper-indicating band 30,130 or the lower edge of the band 30,130. The folding fingers of a first length 40 may be shorter than the folding fingers of the second length 42 however this description is only exemplary and should not be considered limitative as the folding fingers of the second length 42 may instead be shorter than the fingers of the first length 40. In either case the longer folding fingers extend above the neck finish bead 80. The folding fingers of the first length 40 may be some preselected geometric shape such as trapezoidal, substantially rectangular as depicted in FIG. 3, or some other shape. And, the thickness of the folding finger 40 may be uniform, tapered, or as shown in FIGS. 3 and 4, maybe tapered adjacent a connection to the tamper indicating band 30 to facilitate folding of the fingers 40. At a first end of the folding finger 40 is a hinged connection 43. Opposite the hinged connection is a distal end 41 which engages a lower edge or surface portion of container neck bead or finish bead 80. As the closure 12 is threadably removed from a container neck 72, the first length fingers 40 engage the finish bead 80 and inhibit linear movement of the tamper-indicating band 30 with the closure 12 as depicted in FIG. 4. In turn, this causes rupture of the frangible webs 32 resulting in a clearly visible discernable separation of the tamper-indicating or pilfer band 30 from the skirt portion 18, providing a clear indication the container 70 has been opened.

Figure 2:
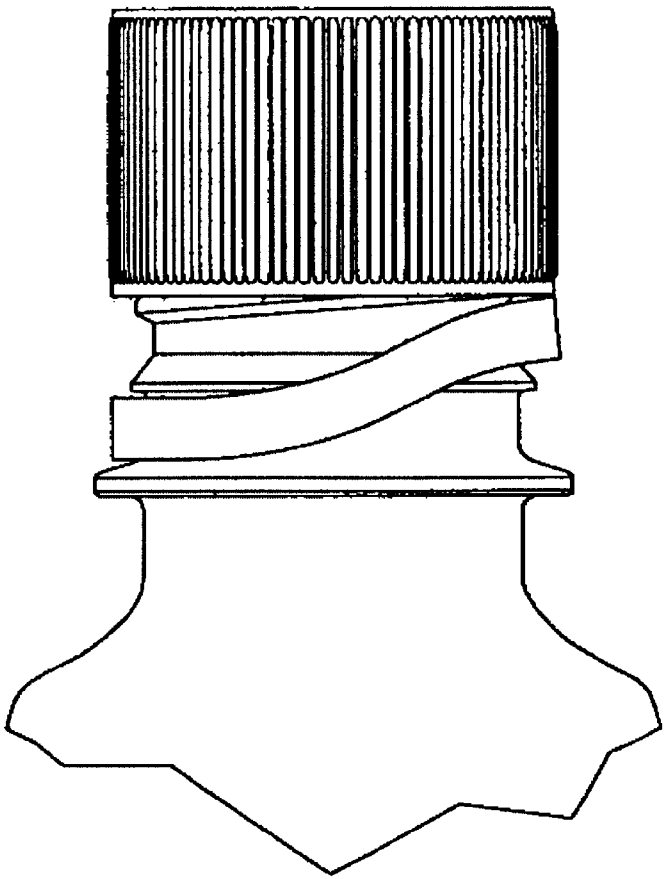
FIG. 2 PRIOR ART
FIG. 2 shows a side view of the prior art closure and container having a typical tamper-indicating band "tiring" over a finish bead.

However, as discussed above, in many cases the webs do not completely fracture which may result in the tamper-indicating band tiring over the container finish bead. Typically about one-half of the webs break forming a "smiler" wherein some portion of the webs are attached and some portion of the webs are detached. When the detached portion of the tamper-indicating band falls beneath the finish bead, the detached portion of the band is pulled radially inward against the container neck as the closure is unscrewed and the attached portion of the band moves upward along the container neck over the bead as shown in FIG. 2. As a result, the tamper-indicating band may "tire" over the finish bead, which is highly undesirable.

In a preferred embodiment, a plurality of folding fingers of a second length 42 are provided between first length folding fingers 40 such that the design includes a first plurality of folding fingers of a first length 40 and a second plurality of folding fingers of a second length 42 as shown in FIGS. 3 and 4. The second length folding fingers 42 extend from a lower edge portion of the tamper-indicating band 30 and may have a preselected geometric shape such as trapezoidal or, as depicted in FIG. 3, substantially square shape. The fingers 42 also have a length which is longer than the fingers of first length 40. The second length fingers 42 may have a constant thickness, a uniform taper, or as depicted in FIGS. 3 and 4, may be tapered near the hinged connection 43 to the tamper-indicating band inner surface 34 thereby facilitating folding of the fingers 42. In accordance with one embodiment, the thickness "T" of the second length fingers 42 should be less than a distance "W" defined between the inner surface of the tamper-indicating band 34 and an outer surface of the neck finish bead 80, such that the finger of the second length 42 extends above the neck finish bead 80 and between the finish bead 80 and tamper-indicating band 30.

Extending from the second length fingers 42 are protrusions 50 which, for example, may be positioned near a distal end portion 48 or may be at some point between the distal end portion 48 and a connection with the tamper-indicating band 30,130. The protrusions, ribs, or lugs 50 may be any shape such that the protrusion extends radially inward a distance greater than the dimension "W". In other words, the protrusion 50 is inhibited from dropping beneath the finish bead 80 and retains the tamper-indicating band 30 in vertical relation with the finish bead 80. Alternatively, the protrusions 50 may also be an offset surface such that the when the folding fingers 42 are directed upwardly, as shown in FIG. 4, the protrusion 50 extends radially inward in interference engagement with an outer wall of the neck finish bead 80.

In accordance with an embodiment, a lower surface 52 of protrusion 50 is angled parallel to an angled surface of the neck finish bead 80. With this design the lower surface 52 and the angled surface of the finish bead 80 are formed having substantially equal angles or parallel surfaces maximizing frictional engagement. The instant invention may be further characterized in that the inner diameter of the protrusion 50, measured along an upper portion of inner surface 52, is less than an outer diameter measured along the outer surface of the neck bead 80. When the closure 12 is removed from the container 70, the size of the protrusion 50 relative to the distance "W" prevents the protrusion 50 from dropping between the tamper-indicating band 30 and the neck finish bead 80 thus inhibiting "tiring" of the tamper-indicating band 30.

Since the closure 12 may be placed on a container undergoing pasteurization or hot sterilization, the design may comprise fluid paths or gaps 44 from within the closure to outside the closure. Therefore, the fingers 40,42 are not connected along a lower edge portion of the tamper-indicating band 30 but instead have at least one gap 44 therebetween. The at least one gap 44 disposed between the fingers 40,42 allows process bath fluid which may be trapped between the fingers 40,42 to escape, inhibiting bacterial and fungal growth. However, such a design is not necessary to utilize the inventive features of the present invention.

In use, the closure 12 is applied to a container neck 72 by direct downward force or threadably connection. The folding fingers 40,42 are folded upward as the closure 12 is applied so that the protrusions 50 are disposed above the neck bead 80. This design serves as a radial displacement prevention means maintaining the folding fingers 40,42 in continued interference engagement with he neck bead 80 and thus inhibits a detached portion of the tamper-indicating band 30,130 from being pulled radially inward allowing tiring over the neck bead 80.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A tamper-indicating band arrester and container neck, comprising:

a closure having a top wall and an annular skirt depending from said top wall;

an internal thread helically extending about an inner surface of said annular skirt;

a tamper-indicating band frangibly connected to a lower edge portion of said annular skirt by a plurality of webs;

said tamper-indicating band having a plurality of folding fingers;

said folding fingers having a first plurality of folding fingers of a first radial length;

said folding fingers having a second plurality of folding fingers of a second radial length, said first length shorter than said second length;

a container having at least one external thread helically extending about a neck, and a neck bead extending about said neck beneath said thread;

said folding fingers of said second length including an offset surface;

said folding finger of said second length extending above said neck bead and said offset surface extending radially inward above said neck bead.

2. The tamper-indicating band arrester and container neck of claim 1, said folding finger of said first length engaging a lower surface of said neck bead.

3. The tamper-indication band arrester and container neck of claim 1, said offset surface disposed at a distal end of said folding fingers of said second length.

4. The tamper-indicating band arrester and container neck of claim 1, said offset surface engaging said neck bead.

5. A tamper-indicating band arrester, comprising:

a closure having a top wall and an annular skirt depending from said top wall;

said skirt having an internal thread extending helically about inwardly from an inner surface thereof;

a tamper-indicating band releasably connected to said skirt by a plurality of frangible webs;

a plurality of folding fingers of a shorter length and a plurality of folding fingers of a longer length extending from near a lower edge portion of said tamper-indicating band, said folding fingers of said longer length having a protrusion extending therefrom;

said closure threadably disposed on a container neck finish, said container neck finish including a finish bead;

said protrusion being sized greater than a distance defined between an inner surface of said tamper-indicating band and an outer surface of said finish bead.

6. The tamper-indicating band arrester of claim 5, said protrusion of said folding fingers disposed above said finish bead.

7. The tamper-indicating band arrester of claim 6, said protrusion being in radial engagement with said finish bead.

8. The tamper-indicating band arrester of claim 5, wherein said folding fingers of said shorter length are in interference relationship with a lower surface of said finish bead.

9. The tamper-indicating band arrester of claim 5, said protrusion defining a circumference having a diameter less than a circumference defined by said finish bead.

10. A tamper-indicating band arrester, comprising:

a closure having a top wall and an annular skirt depending from a peripheral edge of said top wall;

said skirt having a thread helically extending along an inner surface of said skirt;

said closure having a tamper-indicating band frangibly connected to a lower portion of said skirt;

said tamper-indicating band having a plurality of folding fingers extending radially inward from said tamper-indicating band;

said plurality of folding fingers having alternating shorter lengths and longer lengths;

said longer length fingers having an offset surface disposed at a distal end;

said offset surface of said fingers disposed above a neck finish bead of a container neck finish and having a radial dimension greater than a distance defined between said tamper-indicating band and said finish bead;

said offset surface defining a circumference having a diameter less than a circumference defined by said finish bead.

11. The tamper-indicating band arrester of claim 10, said finish bead being substantially parallel with a lower surface of said offset surface of said fingers.

* * * * *